US006408467B2

(12) United States Patent
Walpin

(10) Patent No.: US 6,408,467 B2
(45) **Date of Patent: *Jun. 25, 2002**

(54) ORTHOPEDIC HEAD AND NECK SUPPORT PILLOW THAT REQUIRES NO BREAK-IN PERIOD

(76) Inventor: Lionel A. Walpin, 127 W. Hazel St., Inglewood, CA (US) 90302

( * ) Notice: Subject to any disclaimer, the term of this patent is extended or adjusted under 35 U.S.C. 154(b) by 0 days.

This patent is subject to a terminal disclaimer.

(21) Appl. No.: 09/778,018

(22) Filed: Feb. 5, 2001

Related U.S. Application Data

(63) Continuation of application No. 09/496,834, filed on Feb. 2, 2000, now Pat. No. 6,182,312.

(51) Int. Cl.[7] ..... A47G 9/14
(52) U.S. Cl. ..... 5/636; 5/644
(58) Field of Search ..... 5/636, 639, 640, 5/643, 644

(56) References Cited

U.S. PATENT DOCUMENTS

| | | | | | |
|---|---|---|---|---|---|
| 2,167,622 | A | | 8/1939 | Bentivoglio | 5/338 |
| 2,940,087 | A | | 6/1960 | Kiefer | 5/338 |
| 3,000,670 | A | | 9/1961 | Clark | 297/461 |
| 3,070,540 | A | | 12/1962 | Stanton | 297/421 |
| 3,239,854 | A | | 3/1966 | Freedlander | 5/337 |
| 3,243,828 | A | | 4/1966 | McCarty | 5/338 |
| 3,403,414 | A | | 10/1968 | Unger | 5/355 |
| 3,521,310 | A | | 7/1970 | Greenawalt | 5/337 |
| 3,829,917 | A | | 8/1974 | De Laittre et al. | 5/338 |
| 3,924,283 | A | | 12/1975 | Shave | 5/636 |
| 4,207,636 | A | * | 6/1980 | Ceriani | 428/101 |
| 4,320,543 | A | | 3/1982 | Dixon | 5/434 |
| 4,393,530 | A | | 7/1983 | Stark | 5/437 |
| 4,494,261 | A | | 1/1985 | Morrow | 5/436 |
| 4,501,034 | A | | 2/1985 | Greenawalt | 5/636 X |
| 4,574,411 | A | | 3/1986 | Yagi | 5/434 |
| 4,752,982 | A | | 6/1988 | Jones et al. | 5/433 |
| 4,799,275 | A | * | 1/1989 | Sprague | 5/636 |
| 4,835,801 | A | | 6/1989 | Walpin | 5/432 |
| 4,850,068 | A | | 7/1989 | Walpin | 5/434 |
| 4,853,993 | A | | 8/1989 | Walpin | 5/431 |
| 4,899,405 | A | | 2/1990 | Rothbard | 5/636 |
| 4,916,765 | A | | 4/1990 | Castronovo, Jr. | 5/636 X |
| 5,588,168 | A | * | 12/1996 | Byrne et al. | 5/636 |
| 5,638,564 | A | | 6/1997 | Greenawalt et al. | 5/636 |
| 6,006,380 | A | | 12/1999 | Sramek | 5/636 |
| 6,182,312 | B1 | * | 2/2001 | Walpin | 5/636 |
| 6,317,908 | B1 | * | 11/2001 | Walpin | 5/636 |

* cited by examiner

*Primary Examiner*—Michael F. Trettel
(74) *Attorney, Agent, or Firm*—Lyon & Lyon LLP

(57) ABSTRACT

An orthopedic pillow that comprises several components of varying densities, which in combination provide improved and more immediate comfortable support for the head and neck region, while enhancing the multi-alignment features for the spine, head, and neck of a user in back-lying and side-lying body positions, and do not require the user to endure a break-in period to allow the pillow to conform to the shape of the user's head. The pillow comprises a firm core comprising a first and second lengthwise edge, a top surface, and a bottom surface; a recess located on the top surface of the core; a layer of soft, viscoelastic foam located within the recess; a layer of soft, Dacron fiber located along a top surface of the layer of foam; and a soft, C-shaped layer of viscoelastic foam wrapped around the core, whereby the C-shaped layer of foam covers the first lengthwise edge of the core, the bottom surface of the core, and the second lengthwise edge of the core.

14 Claims, 1 Drawing Sheet

ORTHOPEDIC HEAD AND NECK SUPPORT PILLOW THAT REQUIRES NO BREAK-IN PERIOD

This application is a continuation of U.S. application Ser. No. 09/496,834, filed Feb. 2, 2000, now U.S. Pat. No. 6,182,312.

FIELD OF THE INVENTION

This invention pertains to the field of orthopedic pillows, in particular, orthopedic support pillows that provide support for the head and neck region.

BACKGROUND OF THE INVENTION

Today, pillows come in a wide variety of forms. Traditional, non-orthopedic pillows typically consist of rectangular, fabric enclosures filled with feathers, down, chipped foam, or a polyester fill. These pillows may be shaped by the user to provide reasonably adequate support for the user while the user falls asleep. However, many people suffer from an uncomfortable night's sleep because of the inadequate support that their head and neck receive while using these traditional pillows throughout the night. This is because traditional pillows either have a body that is so soft that the neck support area compresses to result in no support, or the body is so firm that the head sits considerably higher than the shoulders of the user, resulting in an abnormal sleeping position. Chronic neck pain or stiffness and a tense upper back are often the result of these inadequate forms of support these traditional pillows provide.

For this reason, many people turn to orthopedic pillows in an attempt to furnish them a more comfortable and healthier night's sleep. Orthopedic pillows are designed to provide users with proper support and alignment of their head and neck. A multitude of different orthopedic pillow designs exist, many of which offer different methods for improved positioning of users heads and necks as they sleep. The many different cervical pillows do this to one extent or another through different designs. Cervical pillows in general work by providing a raised surface under the back of a user's neck, thereby supporting the neck forward and allowing the head to fall back, thus maintaining the lordotic neck curve while the user is back-lying, and to support the head and neck in the side-lying position. This action provides support to underlying muscles in the cervical spine region that tend to be weak, and it correctly aligns the spine, head, and neck. A well known and exemplary model of a cervical pillow is the Wal-Pil-O® pillow by Roloke Company, which utilized U.S. Pat. No. 3,521,310 issued to Greenawalt. This pillow allows the user four different combinations of head and neck support in both back-lying and in side-lying positions.

Many of these orthopedic pillows use a resilient foam material, such as a flexible polyurethane foam, to provide the necessary support to the head and neck. Another foam used in manufacturing the pillows is viscoelastic memory foam. Viscoelastic memory foam is designed to retain the shape or form of the user's head as the user sleeps on the pillow every night. This function of retaining the shape of a user's head aids in providing a more comfortable sleeping experience for the user.

One major drawback of ordinary polyurethane foam cervical pillows is that they typically have to be broken in before the pillows achieve their greatest level of comfort. "Breaking in" a pillow simply refers to the process of repeatedly compressing the foam of a pillow during its initial usage. The compression is caused by the weight of a user's head sleeping on the foam night after night. This repeated compression of the foam every time the user is sleeping compresses the internal structure of the foam and pushes air out from within the structure. The polymers of the foam tend to "remember" this compressed structure, and this "memory" makes the polymers tend to bias towards the compressed structure. Through this breaking-in process, the foam becomes softer and more resilient in the area of the compressed structure, and because the area of the compressed structure corresponds to the area where the user's head is pushing down on the foam, the foam is thus "conforming" to the shape of the user's head.

This break-in period can last anywhere from several days to a week or more before the foam adequately and comfortably retains the shape of a user's head. This long of a break-in period may be unacceptable to potential users who require the head and neck support these pillows offer, but are unable to endure the stiffness of a non-broken-in foam due to their medical conditions. For instance, users that have chronic or acute neck disorders, or that have suffered a recent head trauma or neck injury typically cannot withstand any length of a break-in period.

Accordingly, there is a need for a foam, orthopedic pillow that provides comfortable head and neck support, correctly aligns the spine, head, and neck, and requires no break-in period.

SUMMARY OF THE INVENTION

The present invention addresses the above mentioned problem. The orthopedic pillow of the present invention is a pillow that comprises several components of varying densities, which in combination provide improved support for the head and neck region, correctly align the spine, head, and neck of a user for comfortable, therapeutic benefits, and do not require the user to endure a break-in period to allow the pillow to conform to the shape of the user's head.

The present invention comprises a firm core comprising a first and second lengthwise edge, a top surface, and a bottom surface; a recess located on the top surface of the core; a layer of soft, viscoelastic foam located within the recess; a layer of soft, Dacron fiber located along a top surface of the layer of foam; and a soft, C-shaped layer of viscoelastic foam wrapped around the core, whereby the C-shaped layer of foam covers the first lengthwise edge of the core, the bottom surface of the core, and the second lengthwise edge of the core.

DETAILED DESCRIPTION OF THE INVENTION

Figure 1:
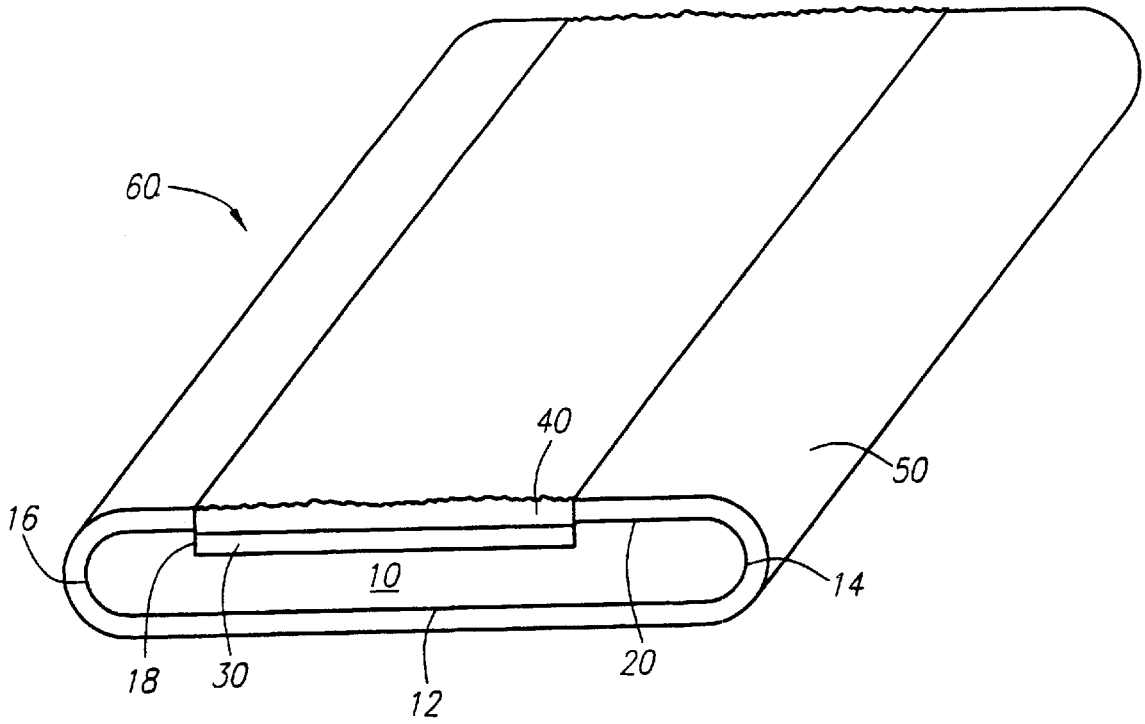
FIG. 1 is a three dimensional diagram of the pillow of the present invention.

Turning to FIG. 1, the pillow 60 of the present invention contains a core 10. The core 10 is preferably formed from a foam material, such as a polyurethane foam, foam rubber, viscoelastic foam, or any other foam known in the art to be satisfactory for this use. It is preferred that the foam used for core 10 be a firm foam that has a high density relative to the materials used in constructing the other components of the present invention. In a currently preferred embodiment of the present invention, 180/28 polyurethane foam is used (also known in the industry simply as 18/28 foam) for the core 10.

Core 10 is preferably a rectangular shape with rounded lengthwise edges 14 and 16. The top surface 20 of the core 10 preferably contains a recess 18. In a preferred embodiment, recess 18 is rectangular in shape, as shown in FIG. 1, and extends the length of the pillow 60. It is preferred that during manufacture of the present invention, core 10 initially be formed without recess 18, and that recess 18 then be formed by cutting away a rectangular prism section of foam from top surface 20. In alternate embodiments, the recess 18 may take the form of other shapes, including a concave-circular depression, a concave-elliptical depression, or a concave depression that extends the length of the pillow 60.

The recess 18 is preferably positioned closer to lengthwise edge 16 than to lengthwise edge 14. This results in lengthwise edge 14 being wider than lengthwise edge 16. This variation in the widths of the lengthwise edges 14 and 16 provides users with two options as to how they can orient the pillow 60, thus users with longer necks may find that use of lengthwise edge 14 provides greater support and comfort, and users with shorter necks may find that lengthwise edge 16 is better suited for their bodies. In alternate embodiments, the two lengthwise edges may be made of equal widths.

The core 10 is preferably eleven to fifteen inches in width, and preferably one to four inches in height (not accounting for the recess 18). Preferably, the length of core 10 is anywhere from twenty to thirty inches. Recess 18 is preferably anywhere from half an inch to three inches deep at its deepest point.

In a preferred embodiment, recess 18 contains a foam layer 30. This foam layer 30 is preferably anywhere from one-quarter of an inch to two inches in thickness. Foam layer 30 comprises a foam that is preferably softer and less dense than the foam used for core 10. Preferably, the foam used in foam layer 30 is a memory foam, such as a viscoelastic memory foam. In a currently preferred embodiment of the present invention, foam layer 30 is comprised of three pound viscoelastic memory foam. In alternate embodiments, foam layer 30 may comprise a foam rubber, a polyurethane foam, or any other foam known in the art that is suitable for use in this invention.

Foam layer 30 tends to provide a comfortable transition between the firm core 10 and a user's head. In addition, use of a viscoelastic foam for manufacturing the foam layer 30 is designed to allow the pillow to quickly conform to the shape of a user's head without the need for a break-in period. This is because viscoelastic foam requires little to no break-in period to conform to the shape of a user's head.

A cushion layer 40 is preferably located atop the foam layer 30. In a presently preferred embodiment, this cushion layer 40 is anywhere from one-quarter to two inches in thickness. Cushion layer 40 is designed to provide a soft surface against which a user's head will rest while utilizing the pillow 60. In a currently preferred embodiment of the present invention, 1.1 oz. low-melt Dacron fiber is used. In alternate embodiments, cushion layer 40 may comprise a polyester fiber material, a cotton fiber material, goose feathers or down, or other soft fiber, foam, or other materials known in the art that are suitable for this purpose.

In a preferred embodiment of the present invention, a C-shaped outer layer 50 wraps around the core 10. The C-shaped outer layer 50 preferably covers the first lengthwise edge 14, the second lengthwise edge 16, and the bottom surface 12 of the core 10. In a preferred embodiment, the C-shaped outer layer may be anywhere from one-quarter of an inch to two inches in thickness. This C-shaped outer layer 50 is designed to provide better comfort for a user's neck and shoulder region. This C-shaped outer layer 50 also enhances the multi head and neck alignment feature of the pillow 60.

Preferably, the C-shaped outer layer 50 comprises a viscoelastic memory foam, thereby enabling it to conform to the shape of a user's head and neck region with no need for a break-in period. In a currently preferred embodiment of the present invention, three pound viscoelastic memory foam is used in forming the C-shaped outer layer 50. In alternate embodiments, the C-shaped outer layer 50 may comprise a polyurethane foam, foam rubber, or other foams that are known in the art that would be suitable for use in this invention.

The C-shaped outer layer 50 enhances an important design advantage of this pillow 60, which is allowing the head and neck to be placed in four different alignments in back-lying and side-lying body positions. When the lengthwise edges 14 and 16 are of unequal widths, there is a choice of four alignments in back-lying and side-lying positions. Alternately, when the lengthwise edges 14 and 16 are of equal widths, there is a choice of two alignments in back-lying and side-lying positions.

Figure 2:
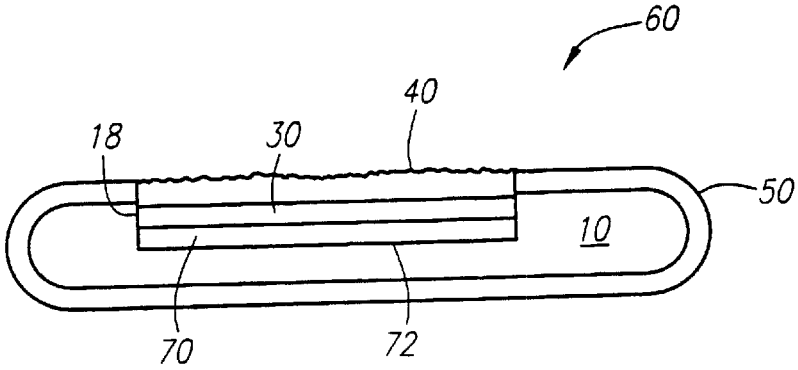
FIG. 2 is a cross-sectional diagram of an alternate embodiment of the present invention.

Turning to FIG. 2, an alternate embodiment of the present invention is shown wherein an extra support layer 70 is positioned on the bottom 72 of the recess 18, sandwiched between the core 10 and the foam layer 30. This extra support layer 70 provides added support for users that require a firmer pillow 60. The extra support layer 70 preferably comprises a high density polyurethane foam, which is higher in density than core 10. In a presently preferred embodiment of the present invention, extra support layer 70 comprises 180/33 polyurethane foam (also known as 18/33 foam). In alternate embodiments, extra support layer 70 may comprise a foam rubber, a viscoelastic foam, or any other foam known in the art that may be suitable for use with the present invention.

Thus, an orthopedic head and neck support pillow utilizing foams of varying densities for providing support to maintain the normal lordotic curve of a user's neck, aligning the spine, head, and neck of a user, and with no break-in period has been described. While embodiments, applications, and advantages of the invention have been shown and described, as would be apparent to ones skilled in the art, many more embodiments, applications, and advantages are possible without deviating from the inventive concepts described herein. The invention, therefore, is not to be restricted except in accordance with the spirit of the appended claims.

I claim:

1. A support device, comprising:

a core comprising a first and a second edge, a top surface, and a bottom surface;

a recess located on said top surface of said core;

a foam layer located within said recess; and a C-shaped outer layer wrapped around said core, covering said first edge of said core, said bottom surface of said core, and said second edge of said core.

2. The support device of claim 1, wherein said recess extends from a first widthwise edge of said core to a second widthwise edge of said core.

3. The support device of claim 2, wherein said recess is located closer in proximity to said first edge than to said second edge.

4. The support device of claim 1, wherein said recess is concave.

5. The support device of claim 4, wherein said recess is also circular.

6. The support device of claim 4, wherein said recess is also elliptical.

7. The support device of claim 1, wherein said recess is angular.

8. The support device of claim 1, wherein said recess is formed by cutting a section of foam out of said top surface of said core.

9. The support device of claim 1, wherein said first and second edges are rounded.

10. The support device of claim 1, wherein said core is formed from a polyurethane foam.

11. The support device of claim 1, wherein said foam layer is formed from a viscoelastic memory foam.

12. The support device of claim 1, wherein said outer layer is formed from a viscoelastic memory foam.

13. The support device of claim 1, further comprising an extra support layer located along said bottom surface of said recess between said core and said foam layer.

14. The support device of claim 13, wherein said extra support layer comprises a polyurethane foam.

* * * * *